US008116510B2

(12) United States Patent
Umemura

(10) Patent No.: US 8,116,510 B2
(45) Date of Patent: Feb. 14, 2012

(54) LOUDSPEAKER

(75) Inventor: Kazuyoshi Umemura, Mie (JP)

(73) Assignee: Panasonic Corporation, Osaka (JP)

( * ) Notice: Subject to any disclaimer, the term of this patent is extended or adjusted under 35 U.S.C. 154(b) by 1188 days.

(21) Appl. No.: 11/908,553

(22) PCT Filed: Feb. 5, 2007

(86) PCT No.: PCT/JP2007/051911
§ 371 (c)(1),
(2), (4) Date: Sep. 13, 2007

(87) PCT Pub. No.: WO2007/091515
PCT Pub. Date: Aug. 16, 2007

(65) Prior Publication Data

US 2009/0052724 A1 Feb. 26, 2009

(30) Foreign Application Priority Data

Feb. 9, 2006 (JP) ..... 2006-032236

(51) Int. Cl.
*H04R 9/02* (2006.01)

(52) U.S. Cl. ..... 381/398; 381/400; 381/413

(58) Field of Classification Search ..... 381/398, 381/400, 413
See application file for complete search history.

(56) References Cited

U.S. PATENT DOCUMENTS

| | | | | |
|---|---|---|---|---|
| 5,847,333 | A | 12/1998 | D'Hoogh | |
| 6,655,495 | B2 | 12/2003 | Kuze et al. | |
| 7,212,647 | B2 * | 5/2007 | Kaneda et al. | 381/396 |
| 2003/0185415 | A1 | 10/2003 | Funahashi et al. | |
| 2005/0078849 | A1 | 4/2005 | Funahashi et al. | |
| 2006/0153416 | A1 * | 7/2006 | Kaneda et al. | 381/396 |
| 2008/0310670 | A1 * | 12/2008 | Itakura | 381/412 |

FOREIGN PATENT DOCUMENTS

| | | |
|---|---|---|
| CN | 1463536 | 12/2003 |
| CN | 1607863 | 4/2005 |
| JP | 45-33465 | 10/1970 |
| JP | 56-49188 | 11/1981 |
| JP | 64-51396 | 3/1989 |
| JP | 2-133097 | 11/1990 |
| JP | 3-247099 | 11/1991 |
| JP | 4-364000 | 12/1992 |
| JP | 11-196491 | 7/1999 |
| JP | 11-510033 | 8/1999 |
| JP | 2003-199192 | 7/2003 |
| JP | 2004-7332 | 1/2004 |

OTHER PUBLICATIONS

International Search Report (in English language) issued May 1, 2007 in PCT/JP2007/051911 of which the present application is the U.S. National Stage.

* cited by examiner

*Primary Examiner* — Alexander Ghyka
*Assistant Examiner* — Stanetta Isaac
(74) *Attorney, Agent, or Firm* — Wenderoth, Lind & Ponack, L.L.P.

(57) ABSTRACT

A magnetic circuit part of a loudspeaker is formed of a plate, a magnet, and a yoke. A step is disposed in the plate that comes into contact with a disc-like magnet and forms a magnetic gap. A loudspeaker is provided where the step moves a voice coil away from the leakage magnetic field of the yoke, the influence of the leakage magnetic field is eliminated even when the output is large, the distortion is small, and the sound quality is high.

10 Claims, 4 Drawing Sheets

LOUDSPEAKER

TECHNICAL FIELD

The present invention relates to an audio loudspeaker.

BACKGROUND ART

FIG. 5 is a half sectional view of one example of a conventional loudspeaker. This loudspeaker is substantially axially symmetric with respect to a dashed line C-C, namely a center line. In FIG. 5, a closed loop of a direct-current magnetic circuit is formed of disk-like plate 1 made of silver, disk-like magnet 2 one-size smaller than plate 1, iron yoke 3, and a narrow clearance (magnetic gap G) between plate 1 and yoke 3. Voice coil 4 is disposed in magnetic gap G, and can move vertically on the drawing. Voice coil 4 is coupled to the inner peripheral end of diaphragm 6 via cylindrical voice coil body 5. Diaphragm 6 vibrates to produce sound. The outer peripheral end of diaphragm 6 is coupled to frame 8 via flexible edge 7. The back surface of diaphragm 6 is coupled to frame 8 via suspension holder 9 and flexible edge 10.

The loudspeaker of FIG. 5, among conventional loudspeakers, has relatively high sound quality. In this loudspeaker, edge 7 and edge 10 project in opposite directions to each other, so that a symmetric characteristic of the vertical amplitude of diaphragm 6 is improved, and this symmetric characteristic reduces sound distortion in the loudspeaker. Since the sound distortion can be reduced, large current can be applied to voice coil 4, and louder sound can be output.

An example of the conventional art document information related to the invention of this application is Japanese Patent Unexamined Publication No. 2004-7332.

When a large current is applied to voice coil 4 in order to output louder sound, however, sound distortion due to the structure of the closed loop magnetic circuit becomes a problem. This sound distortion has not caused a problem before. This phenomenon is described hereinafter.

FIG. 6 is an enlarged side view of the proximity of magnetic gap G. Magnetic gap G refers to a part where plate 1 is closest to yoke 3. In magnetic gap G, magnetic flux F flows from plate 1 toward yoke 3. The vertical center position of the magnetic flux F part is generally set as the center position of the vertical movement of voice coil 4, and voice coil 4 is movable vertically from the center position of the vertical movement. When a large current is applied to voice coil 4 in order to output louder sound, however, the lower end of voice coil 4 moves with a large amplitude downwardly below the bonded surface between magnet 2 and yoke 3 of FIG. 6. On the bonded surface between magnet 2 and yoke 3, however, leakage magnetic flux L returning from a right midway part of yoke 3 to the lower surface of magnet 2 exists. Leakage magnetic flux L flows in the opposite direction to magnetic flux F. When voice coil 4 comes down and enters leakage magnetic flux L, voice coil 4 receives an upward force in the opposite direction to the force from magnetic flux F. When the upward force enlarges the amplitude of voice coil 4, the symmetric characteristic of the amplitude degrades to cause the sound distortion, disadvantageously.

SUMMARY OF THE INVENTION

The loudspeaker of the present invention has a disc-like magnet, a plate in contact with one surface of the magnet, and a yoke that is in contact with the surface of the magnet on the opposite side to the plate and extends to the proximity of a side surface of the plate to form a magnetic gap. The side surface of the plate has a part that has a diameter substantially the same as that of the magnet and is formed on the contact side with the magnet, and a part that has a diameter larger than that of the magnet and projects to form a magnetic gap. The present invention can provide a loudspeaker that causes only small sound distortion even when the output is large.

DETAILED DESCRIPTION OF PREFERRED EMBODIMENTS

Exemplary embodiments of the present invention will be described hereinafter with reference to FIG. 1 through FIG. 4. Each of FIG. 1 through FIG. 4 is a schematic diagram, and does not show the dimensions on an accurate scale.

First Exemplary Embodiment

Figure 1:
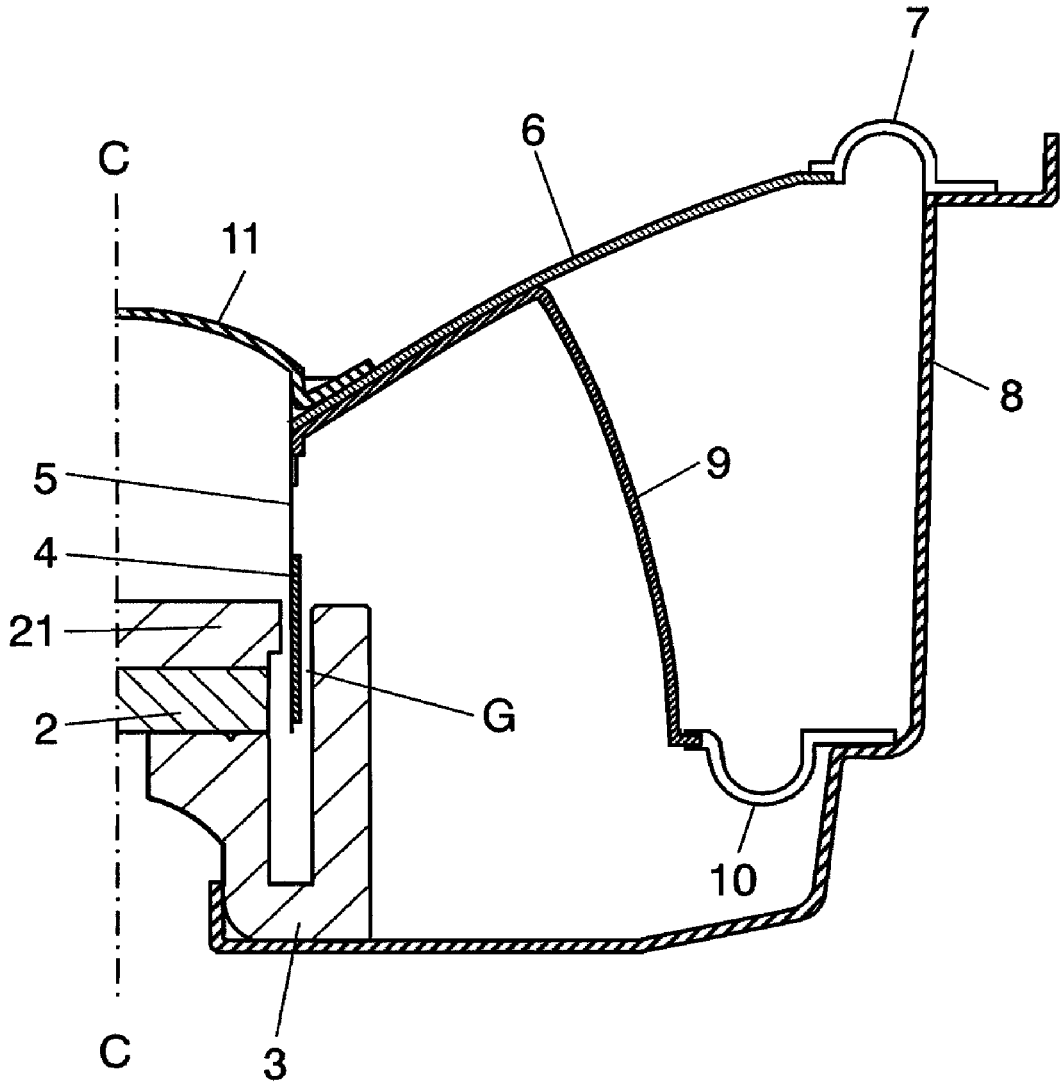
FIG. 1 is a half sectional view of a loudspeaker in accordance with a first exemplary embodiment of the present invention.

FIG. 1 is a sectional view showing the right half formed by cutting a loudspeaker of the present invention on the front side. This loudspeaker is substantially axially symmetric with respect to a dashed line C-C, namely the center line. In FIG. 1, a closed loop of a direct-current magnetic circuit is formed of iron plate 21, disk-like magnet 2, iron yoke 3, and a narrow gap (magnetic gap G) between plate 21 and yoke 3. Voice coil 4 is disposed in magnetic gap G, and can move vertically in the drawing. Voice coil 4 is coupled to the inner peripheral end of diaphragm 6 via cylindrical voice coil body 5. Diaphragm 6 vibrates to produce sound. The outer peripheral end of diaphragm 6 is coupled to frame 8 via first flexible edge 7. The back surface of diaphragm 6 is coupled to frame 8 via suspension holder 9 and flexible edge 10. Voice coil body 5 has a structure where voice coil 4 is wound on the outer periphery of the cylindrical body, and is arranged so as to vertically move in magnetic gap G. Thus, thin-pan-like diaphragm 6 coupled to the outer periphery of the upper part of voice coil body 5 is vibrated. The upper end of voice coil body 5 has dust cap 11 to protect against dust.

Diaphragm 6 works as a sound producing source of the loudspeaker, and is mainly made of pulp and resin having high rigidity and large internal loss. The outer peripheral end of diaphragm 6 is coupled to the opening end of frame 8 via upwardly projecting first edge 7, and the inner peripheral end is fixed to the outer peripheral side of voice coil body 5 with an adhesive (not shown). First edge 7 is made of urethane, expanded rubber, styrene butadiene rubber (SBR), or cloth so as to not apply a large dynamic load to diaphragm 6.

Suspension holder 9 has a circular truncated cone shape as a whole. As shown in FIG. 1, the inner periphery (upper surface flange part) of suspension holder 9 is stuck and fixed to the lower surface side of diaphragm 6 with an adhesive. The inner peripheral end surface inside the inner periphery is fixed to the outer periphery of voice coil body 5 with an adhesive. The outer peripheral end of suspension holder 9 is coupled to frame 8 via second edge 10. Second edge 10 projects in the opposite direction to first edge 7 in the present embodiment.

In this structure, when a voice signal is supplied to voice coil 4, the voice signal reacts with the magnetic field in magnetic gap G to move voice coil body 5 vertically. This movement vibrates diaphragm 6 to transmit sound from the loudspeaker. Especially, in the present embodiment, since diaphragm 6 is supported also by suspension holder 9, the outer peripheral end of suspension holder 9 is coupled to frame 8 via second edge 10, and the projecting direction of second edge 10 is opposite to that of edge 7, the vertical amplitude of diaphragm 6 can be made substantially symmetric in the vertical direction. Therefore, the sound distortion in the loudspeaker is significantly reduced.

For details, both edge 7 and edge 10 are apt to deform in the projecting direction, but hardly deform in the opposite direction. Since edge 7 and edge 10 project in the opposite directions to each other and are symmetric, deforming ease in the vertical direction of edge 7 is substantially the same as that of edge 10. Thus, the vertical amplitude of diaphragm 6 can be made substantially symmetric in the vertical direction, and hence the sound distortion in the loudspeaker can be reduced. Therefore, even when a large current is applied to voice coil 4, voice louder than before can be output without sound distortion.

When a large current is applied to voice coil 4 in order to output louder sound, however, loudspeaker distortion due to the structure of the magnetic circuit occurs similarly to that described with respect to the conventional example.

Figure 2:
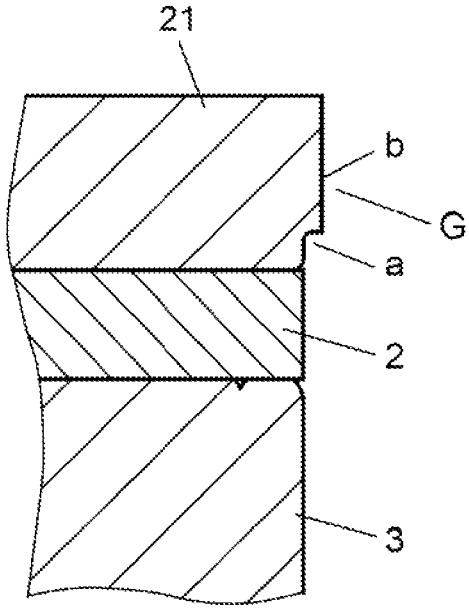
FIG. 2 is an enlarged view of an essential part of FIG. 1.

In the present embodiment, the side surface of disk-like plate 21 constituting the direct-current magnetic circuit has a new shape. FIG. 2 is an enlarged sectional view of an essential part of FIG. 1. As shown in FIG. 2, the cross section of plate 21 is formed of an equal-diameter sectional part (a) having a diameter substantially equal to that of magnet 2 and a projecting part (b) having a cross section with a diameter larger than that of magnet 2. Projecting part (b) is very close to yoke 3, so that magnetic flux F mainly concentrates in projecting part (b), and magnetic flux hardly occurs between equal-diameter sectional part (a) and yoke 3. In other words, plate 1 of the conventional example is thickened by a thickness corresponding to equal-diameter sectional part (a), and hence magnetic gap G is moved up higher than that of the conventional example (to the diaphragm 6 side). The vertical center of voice coil 4 is matched with the vertical center of magnetic gap G, and voice coil 4 is moved vertically from the latter center.

In the case where the vertical center of voice coil 4 is set higher than that in the conventional example, even when a large input is applied to voice coil 4 to largely vibrate it vertically, the lower end of voice coil 4 hardly moves down below the bonded point between magnet 2 and yoke 3. If the lower end moves down below it, the moving distance is short. As a result, the symmetric characteristic of vertical amplitude is hardly damaged, so that a loudspeaker distortion problem hardly arises in the loudspeaker.

Figure 3:
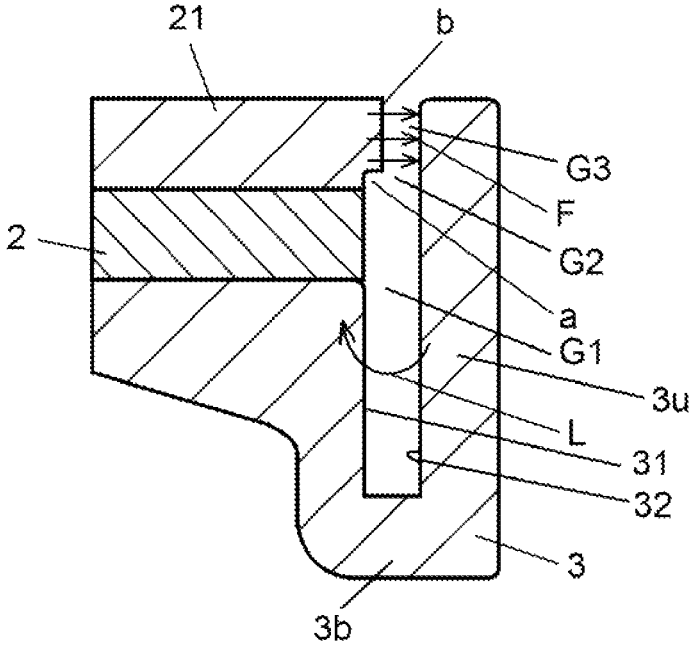
FIG. 3 is an enlarged view of a magnetic circuit part of FIG. 1.

FIG. 3 is an enlarged view of the magnetic circuit part. The magnetic circuit part is further described in detail. On the bonded surface between magnet 2 and yoke 3, however, leakage magnetic flux L returning from a right midway part of yoke 3 to the lower surface of magnet 2 exists. Leakage magnetic flux L flows in the opposite direction to magnetic flux F that flows from plate 21 toward yoke 3 in magnetic gap G. When the lower end of voice coil 4 having received a downward force from magnetic flux F comes down and enters leakage magnetic flux L of the opposite direction to magnetic flux F, voice coil 4 receives an upward force reversely, thereby causing the distortion. In the present embodiment, plate 21 has the equal-diameter sectional part (a) and the projecting part (b), and hence the magnetic gap is moved up higher than that of the conventional example (to the diaphragm 6 side). The vertical center of voice coil 4 is matched with the vertical center of the magnetic gap, and voice coil 4 is moved vertically from the latter center. In the case where the vertical center of voice coil 4 is set higher, even when a large input is applied to voice coil 4 to largely vibrate it vertically, the lower end of voice coil 4 hardly moves down below the bonded point between magnet 2 and yoke 3. If the lower end moves down below it, the moving distance is short. As a result, the loudspeaker distortion problem that is apt to arise in a loudspeaker of a large output hardly arises in the present embodiment.

Thus, as shown especially in FIG. 3, the yoke 3 has an upper surface bonded to the lower surface of the magnet 2, the yoke 3 further including a bottom part 3*b*, a first side surface extending downardly from the upper surface of the yoke to the bottom part 3*b* of the yoke, and an upwardly-extending part 3*u* extending upwardly from the bottom part 3*b* and including a second side surface 32, the second side surface 32 of the yoke facing the first side surface 31 of the yoke and the side surface of said magnet across a first gap portion G1 constituting part of a magnetic gap G. The plate 21 includes a lower part that includes the lower face of the plate and has a diameter identical to that of the magnet 2, and an upper part that includes the upper face of the plate 21 and has a diameter larger than that of the magnet 2. The plate 21 has a side surface that includes an upper side surface part extending downwardly from the upper face of the plate 21 and constituting a side surface of the upper part of the plate, and that includes a lower side surface part extending upwardly from the lower face of the plate 21 and constituting a side surface of the lower part of the plate 21. The lower side surface part of the plate 21 faces the second surface of the yoke 3 across a second gap portion G2 constituting part of the magnetic gap G, and the upper side surface part of the plate faces said second side surface of the yoke 3 across a third gap portion G3 constituting part of the magnetic gap G. The third gap portion G3 is narrower than the first and second gap portions G1 and G2. Also as shown in FIG. 3, an outer part of the upper face of the plate 21 adjoining the side surface of the plate 21 is flush with an inner part of the upper face of the plate 21.

Plate 21 is made of iron, for example. The equal-diameter sectional part (a) with a small cross section can be formed by compression molding with a die from an iron plate whose whole size is equal to that of the projecting part (b). When the equal-diameter sectional part (a) is thus being compression molded, not only does the surface thereof harden but also carbon gathers on the surface. As a result, a magnetic flux hardly occurs from the surface of the sectional part (a). Thus, the magnetic field near the magnetic gap is apt to be stable, and hence the vertical amplitude of voice coil body 5 is apt to be stable.

The materials of plate 21 and yoke 3 are not limited to iron, but any material of high magnetic permeability can be applied. When compression molding is performed partially, metal material is preferable from the viewpoint of ease of formation.

Second Exemplary Embodiment

Figure 4:
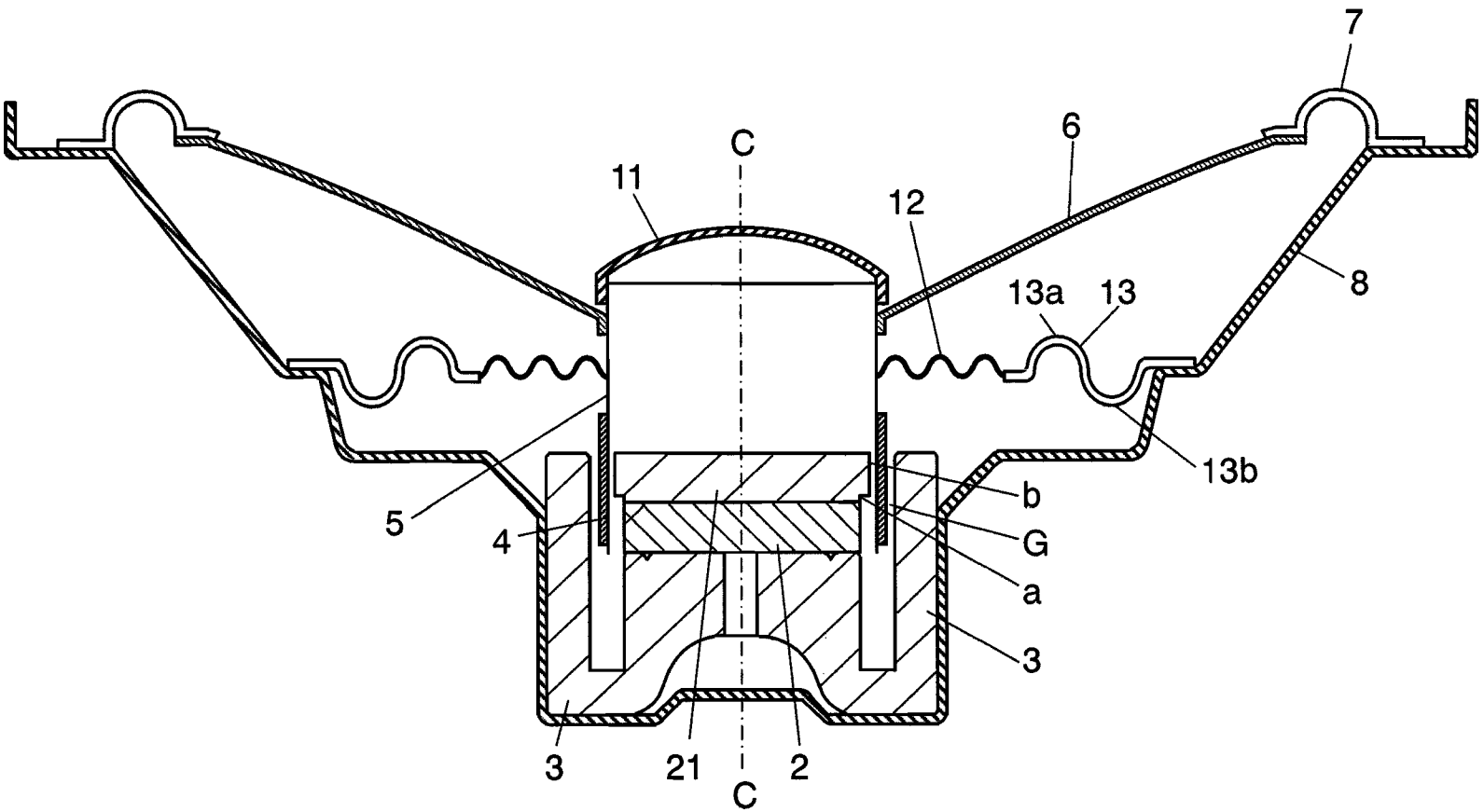
FIG. 4 is a sectional view of a loudspeaker in accordance with a second exemplary embodiment of the present invention.
Figure 5:
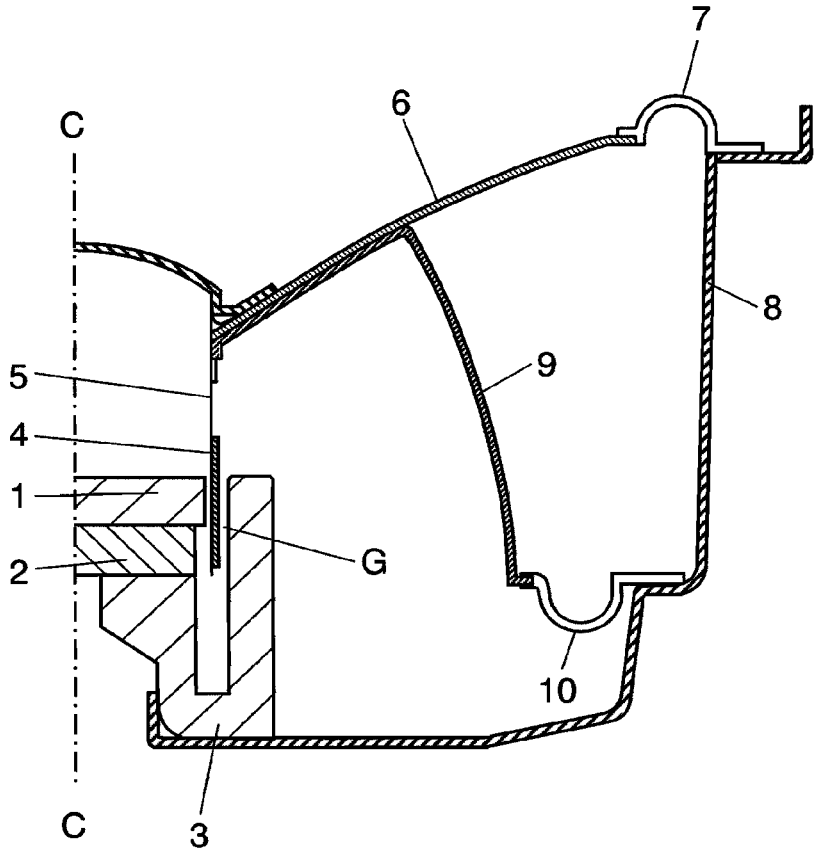
FIG. 5 PRIOR ART
FIG. 5 is a sectional view of a conventional loudspeaker.
Figure 6:
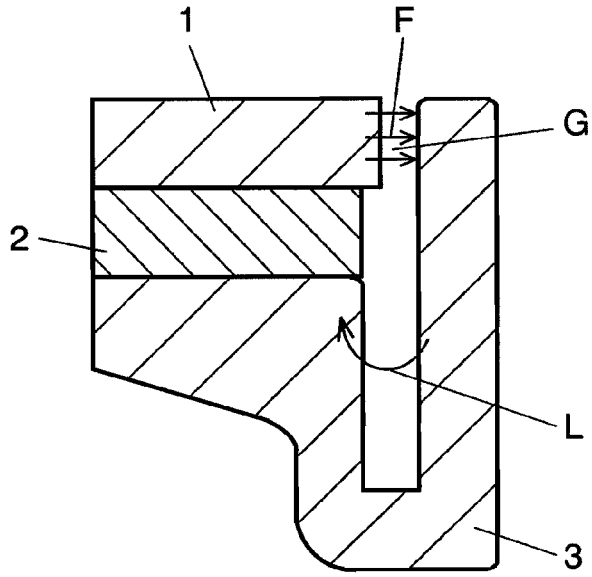
FIG. 6 PRIOR ART
FIG. 6 is an enlarged view of a magnetic gap part of FIG. 5.

FIG. 4 is a sectional view showing a loudspeaker for high/intermediate pitched sound in accordance with a second exemplary embodiment of the present invention. The loudspeaker is substantially axially symmetric with respect to the dashed line C-C, namely the center line. The loudspeaker is formed by combining substantially disk-like plate 21, disk-like magnet 2, and substantially cylindrical yoke 3 and sticking them to the center of the bottom of bowl-shaped metal frame 8, similarly to the first exemplary embodiment. Magnetic gap G is formed between the inner peripheral surface of the outer wall part of yoke 3 and the outer peripheral surface of plate 21. Voice coil body 5 has a structure where voice coil 4 is wound on the outer periphery of the cylindrical body, and is engaged with magnetic gap G so as to move vertically. This vertical movement of voice coil 4 vibrates thin-pan-like diaphragm 6 that is coupled to the outer periphery of the upper part of voice coil body 5. The upper end of voice coil body 5 has dust cap 11 to protect against dust.

Diaphragm 6 works as a sound producing source of the loudspeaker, and is mainly made of pulp and resin having high rigidity and large internal loss. The outer peripheral end of diaphragm 6 is coupled to the opening end of frame 8 via upwardly projecting flexible edge 7, and the inner peripheral end is fixed to voice coil body 5. First edge 7 is made of material such as urethane, expanded rubber, SBR, or cloth so as to not apply a dynamic load to diaphragm 6. The inner peripheral end of damper 12 is coupled to voice coil body 5, and the outer peripheral end thereof is coupled to frame 8 via flexible third edge 13 other than damper 12. Damper 12 has a corrugated-disc-like ring structure, and expands and contracts in response to movement of voice coil body 5. Similarly to edge 7 coupled to diaphragm 6, damper 12 is made of material such as urethane, expanded rubber, SBR, or cloth so as to not apply a dynamic load to diaphragm 6. When a voice signal current is applied to voice coil 4, the voice signal current reacts with the magnetic field in magnetic gap G to move voice coil body 5 vertically. This movement vibrates diaphragm 6 to transmit sound from the loudspeaker.

Especially, in the present embodiment, disposing third edge 13 at the outer peripheral end of damper 12 suppresses the distortion of the loudspeaker, and further increases the driving efficiency of the loudspeaker. This phenomenon is described below.

Conventionally, the outer/inner peripheral ends of damper 12 are coupled to frame 8 and voice coil body 5, respectively, without using third edge 13. The action of damper 12 suppresses rolling during movement of voice coil body 5, and damper 12 has a corrugated plate shape and elasticity to easily follow the movement of voice coil body 5. When the amplitude of voice coil body 5 is small, damper 12 hardly applies a large load to the movement of voice coil body 5. When the amplitude of voice coil body 5 is large, however, damper 12 applies a large load because damper 12 has the corrugated plate shape. In the present embodiment, the outer periphery of damper 12 is coupled to frame 8 via third edge 13. This structure allows voice coil body 5 to move widely, and stress is applied to third edge 13 when damper 12 applies a large load, and third edge 13 elastically deforms in response to the stress. The elastic deformation reduces the stress to suppress reduction of the driving efficiency.

In the present embodiment, voice coil body 5 and diaphragm 6 are supported by edge 7, damper 12, and third edge 13. For increasing the driving efficiency of diaphragm 6 used in a loudspeaker for high/intermediate pitched sound, edge 7 is thinned to be lightened in weight, and hence the weight of diaphragm 6 and edge 7 is reduced. When edge 7 is thinned, however, the supporting strength of voice coil body 5 is reduced. Therefore, third edge 13 is correspondingly made thicker than edge 7 to prevent reduction of the supporting strength of voice coil body 5. As a result, the total modulus of elasticity of damper 12 and third edge 13 is larger (harder) than that of edge 7.

In this structure, since voice coil body 5 is mainly supported by damper 12 and third edge 13, the vertical loads of damper 12 and third edge 13 are required to be as much the same as possible in order to suppress the distortion of vertical movement of diaphragm 6. In the present embodiment, third edge 13 has first projecting part 13*a* projecting toward the diaphragm 6 side, and second projecting part 13*b* projecting in the opposite direction to first projecting part 13*a*. Damper 12 originally has a corrugated-disc-like ring structure, and is substantially symmetric in the vertical direction, so that the vertical load of damper 12 is in substantially the same state. Therefore, in the present embodiment, the vertical load on the bonded body of damper 12 and third edge 13 is substantially symmetric, and excellent sound quality can be obtained even when the output is large. Since edge 7 is lightened in weight, the loudspeaker has high driving efficiency even when it is used for high/intermediate pitched sound.

In this structure where damper 12 is coupled to frame 8 via third edge 13, the power linearity can be secured by corrugated-plate-like damper 12 until the movable width of voice coil body 5 becomes great to some extent. When the movable width of voice coil body 5 is a predetermined value or greater and it is difficult to secure its linearity, the elasticity of third edge 13 compensates for the linearity. In consideration of these functions, preferably, the elasticity of third edge 13 is set larger (harder) than that of damper 12.

The elasticity of damper 12 and third edge 13 are different from each other, and preferably are set so that damper 12 and third edge 13 independently function in response to the movable width of voice coil body 5. The modulus of elasticity of the part between damper 12 and third edge 13, specifically in a coupling region between them, is set larger (harder) than those of damper 12 and third edge 13, thereby securing independence of them.

For setting the modulus of elasticity of the coupling region between damper 12 and third edge 13 to be larger (harder) than those of damper 12 and third edge 13, the following example is effective:

- a hard adhesive such as an acrylic adhesive is used as the adhesive for bonding third edge 13 to damper 12;
- third edge 13 and damper 12 are unified by insert molding and the unified part is thickened; or
- a reinforcing material is stuck to the coupling region.

FIG. 4 shows a loudspeaker that has edge 7 lightened in weight, is used for high/intermediate pitched sound, and has high driving efficiency in the present embodiment. The vertical amplitude of diaphragm 6 is substantially symmetric in the vertical direction, thereby reducing the distortion of the loudspeaker. The magnetic circuit in this loudspeaker has the structure of FIG. 2 similarly to the embodiment shown in FIG. 1. In other words, the end surface on the voice coil body 5 side of disk-like plate 21 constituting the magnetic circuit has the equal-diameter sectional part (a) on the magnet 2 side and the projecting part (b) projecting to the yoke 3 side, as shown in FIG. 2. In other words, plate 21 is thickened by a thickness corresponding to the equal-diameter sectional part (a), and hence magnetic gap G is moved up higher than that of the conventional example (to the diaphragm 6 side). The vertical center of voice coil 4 is matched with the vertical center of magnetic gap G, and voice coil 4 is moved vertically from the latter center. Even when a large input is applied to voice coil 4 to largely vibrate it vertically, the lower end of voice coil 4 hardly moves down below the bonded point between magnet 2 and yoke 3. If the lower end moves down below it, the moving distance is short. Therefore, even when the amplitude increases, the amplitude symmetric characteristics can be kept. As a result, a problem about loudspeaker distortion can be reduced in a low-distortion loudspeaker.

The present invention allows reduction of sound quality distortion occurring when the amplitude is increased to increase the sound volume in a loudspeaker. The present invention is useful for not only a loudspeaker for low pitched sound but also a loudspeaker for high/intermediate pitched sound.

The invention claimed is:

1. A loudspeaker comprising:

a disc-like magnet having an upper surface a lower surface, and a side surface extending between said upper surface of said magnet and said lower surface of said magnet;

a plate having an upper face and a lower face, said lower face being disposed in contact with said upper surface of the magnet;

a yoke having an upper surface bonded to said lower surface of said magnet, said yoke further including a bottom part, a first side surface extending downardly from said upper surface of said yoke to said bottom part of said yoke, and an upwardly-extending part extending upwardly from said bottom part and including a second side surface, said second side surface of said yoke facing said first side surface of said yoke and said side surface of said magnet across a first gap portion constituting part of a magnetic gap;

a voice coil inserted into the magnetic gap; and a diaphragm interlocked with the voice coil;

wherein the plate includes a lower part that includes said lower face of said plate and has a diameter identical to that of the magnet, and an upper part that includes said upper face of said plate and has a diameter larger than that of the magnet;

wherein the plate has a side surface that includes an upper side surface part extending downwardly from said upper face of the plate and constituting a side surface of said upper part of the plate, and that includes a lower side surface part extending upwardly from the lower face of the plate and constituting a side surface of said lower part of the plate; and wherein the lower side surface part of the plate faces said second surface of said yoke across a second gap portion constituting part of the magnetic gap, and the upper side surface part of the plate faces said second side surface of said yoke across a third gap portion constituting part of the magnetic gap; and wherein the third gap portion is narrower than the first and second gap portions.

2. The loudspeaker of claim 1, further comprising:

a frame;

a first edge for supporting the diaphragm, the first edge being coupled to the frame;

a voice coil body for supporting the voice coil;

a suspension holder, an inner peripheral side of the suspension holder being fixed to one of the diaphragm and the voice coil body; and a second edge for supporting an outer peripheral side of the suspension holder, the second edge being coupled to the frame, wherein the first edge and the second edge project in the opposite directions to each other.

3. The loudspeaker of claim 2, wherein said lower face of the plate is constituted by a compression molded surface.

4. The loudspeaker of claim 1, further comprising:

a frame;

a voice coil body for supporting the voice coil;

a first edge for supporting the diaphragm, the first edge being coupled to the frame;

a damper for supporting the voice coil body on an inner peripheral side of the damper; and a second edge for supporting the damper on an outer peripheral side of the third edge, the third edge being coupled to the frame.

5. The loudspeaker of claim 4, wherein a modulus of elasticity of the second edge is larger than a modulus of elasticity of the damper.

6. The loudspeaker of claim 5, wherein said lower face of the plate is constituted by a compression molded surface.

7. The loudspeaker of claim 4, wherein said lower face of the plate is constituted by a compression molded surface.

8. The loudspeaker of claim 1, wherein said lower face of the plate is constituted by a compression molded surface.

9. The loudspeaker of claim 1, wherein a lower end of the voice coil faces the bottom part of the yoke via a gap, and wherein a vertical center of the voice coil is matched with a vertical center of the magnetic gap so that the lower end of the voice coil will hardly move down below the upper surface of the yoke.

10. The loudspeaker of claim 1, wherein an outer part of said upper face of said plate adjoining said side surface of said plate is flush with an inner part of said upper face of said plate.

* * * * *